US008115119B2

(12) United States Patent
Chen

(10) Patent No.: US 8,115,119 B2
(45) Date of Patent: Feb. 14, 2012

(54) MULTI-DIRECTIONAL KEY AND KEY ASSEMBLY

(75) Inventor: Wei-Hsi Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 859 days.

(21) Appl. No.: 12/188,206

(22) Filed: Aug. 8, 2008

(65) Prior Publication Data

US 2009/0178912 A1 Jul. 16, 2009

(30) Foreign Application Priority Data

Jan. 11, 2008 (CN) ..... 2008 1 0300074

(51) Int. Cl.
*H01H 9/26* (2006.01)
*H01H 13/72* (2006.01)
*H01H 13/76* (2006.01)

(52) U.S. Cl. ..... 200/5 A; 200/6 A

(58) Field of Classification Search ..... 200/5 A, 200/1 B, 341, 345, 520
See application file for complete search history.

(56) References Cited

U.S. PATENT DOCUMENTS

| | | | | |
|---|---|---|---|---|
| 4,590,338 | A * | 5/1986 | Suzuki | 200/5 R |
| 6,080,941 | A | 6/2000 | Yokobori | |
| 6,949,996 | B2 * | 9/2005 | Matsumoto et al. | 335/78 |
| 7,745,742 | B2 * | 6/2010 | Li et al. | 200/5 R |

FOREIGN PATENT DOCUMENTS

TW M294065 7/2006

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A multi-directional key for an electronic device includes a hollow frame a key substrate, a multi-directional key body, and a supporting frame. The hollow frame includes a pair of first opposite parallel bars and a pair of second opposite parallel bars. Perpendicular planes of the first opposite parallel bars and perpendicular planes of the second opposite parallel bars are substantially perpendicular to each other. Each of two opposite sides of the key substrate is correspondingly connected to each of the first opposite parallel bars of the hollow frame by a pair of first connection portions. The multi-directional key body is positioned on the key substrate. The supporting frame is connected to the second opposite parallel bars of the hollow frame by a pair of second connection portions. A key assembly employing the multi-directional key is also provided.

17 Claims, 9 Drawing Sheets

MULTI-DIRECTIONAL KEY AND KEY ASSEMBLY

BACKGROUND

1. Field of the Invention

Embodiments of the present disclosure relate to keys in electronic devices and, more particularly to a multi-directional key for an electronic device.

2. Description of Related Art

A plurality of keys may be positioned on the shells of electronic devices, such as mobile phones and set-top boxes. These keys may be pressed to control one or more operations of the electronic devices. These keys are typically placed in close proximity to each other in order to reduce the overall size of the electronic devices often resulting in one of the keys interfering with one or more other keys on the shell of an electronic device. As a result, the electronic devices may be operated erroneously.

Therefore, a heretofore unaddressed need exists in electronic devices to overcome the aforementioned deficiencies and inadequacies.

SUMMARY

A multi-directional key for an electronic device, including: a hollow frame, including a pair of first opposite parallel bars and a pair of second opposite parallel bars, wherein perpendicular planes of the first opposite parallel bars and perpendicular planes of the second opposite parallel bars are substantially perpendicular to each other; a key substrate, wherein each of two opposite sides of the key substrate is correspondingly connected to each of the first opposite parallel bars of the hollow frame by a pair of first connection portions; a multi-directional key body positioned on the key substrate; and a supporting frame connected to the second opposite parallel bars of the hollow frame by a pair of second connection portions.

Other advantages and novel features of the present disclosure will be drawn from the following detailed description, in which:

DETAILED DESCRIPTION OF CERTAIN INVENTION EMBODIMENTS

Figure 1:
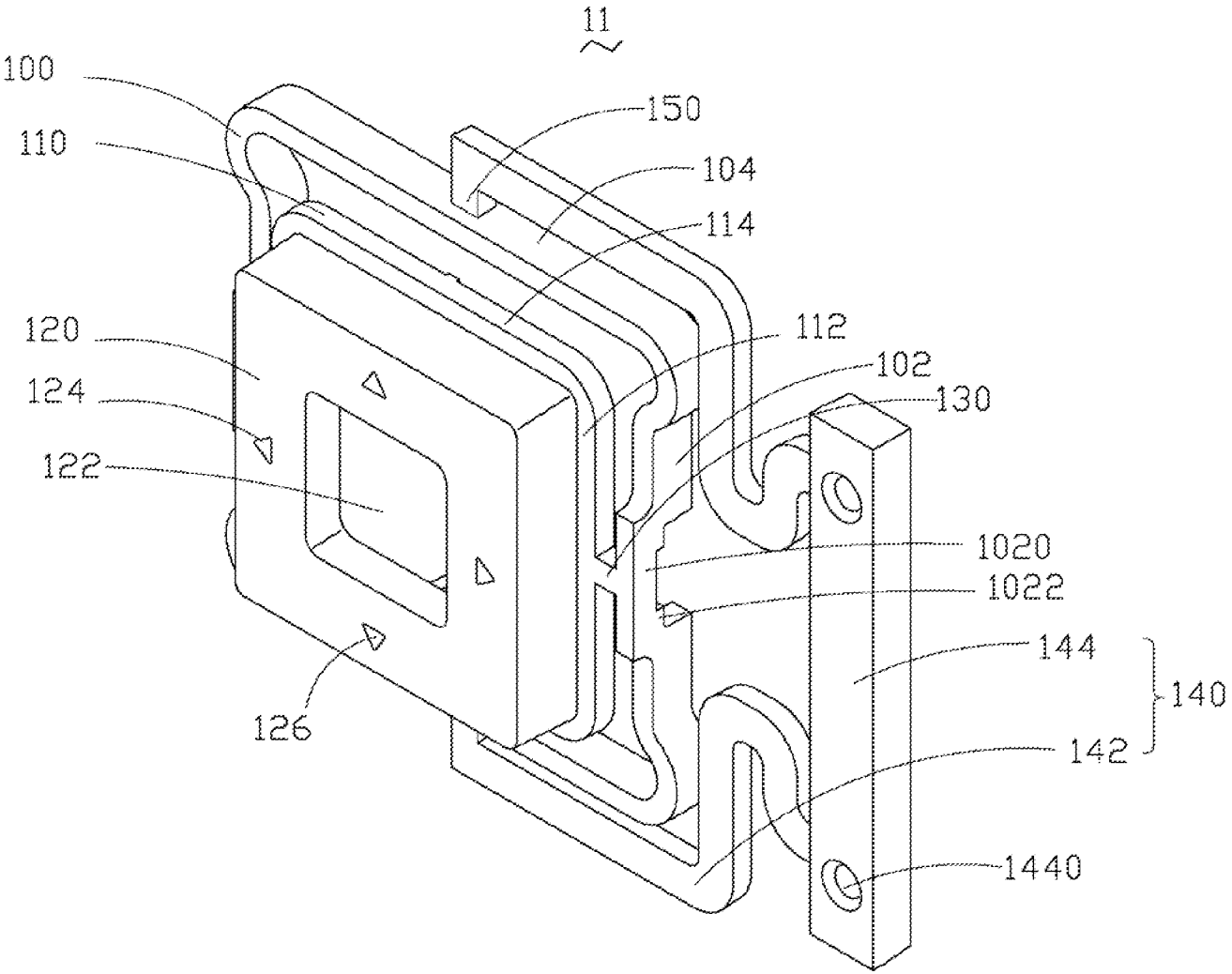
FIG. 1 is an isometric view of one embodiment of a multi-directional key in accordance with the present disclosure.
Figure 2:
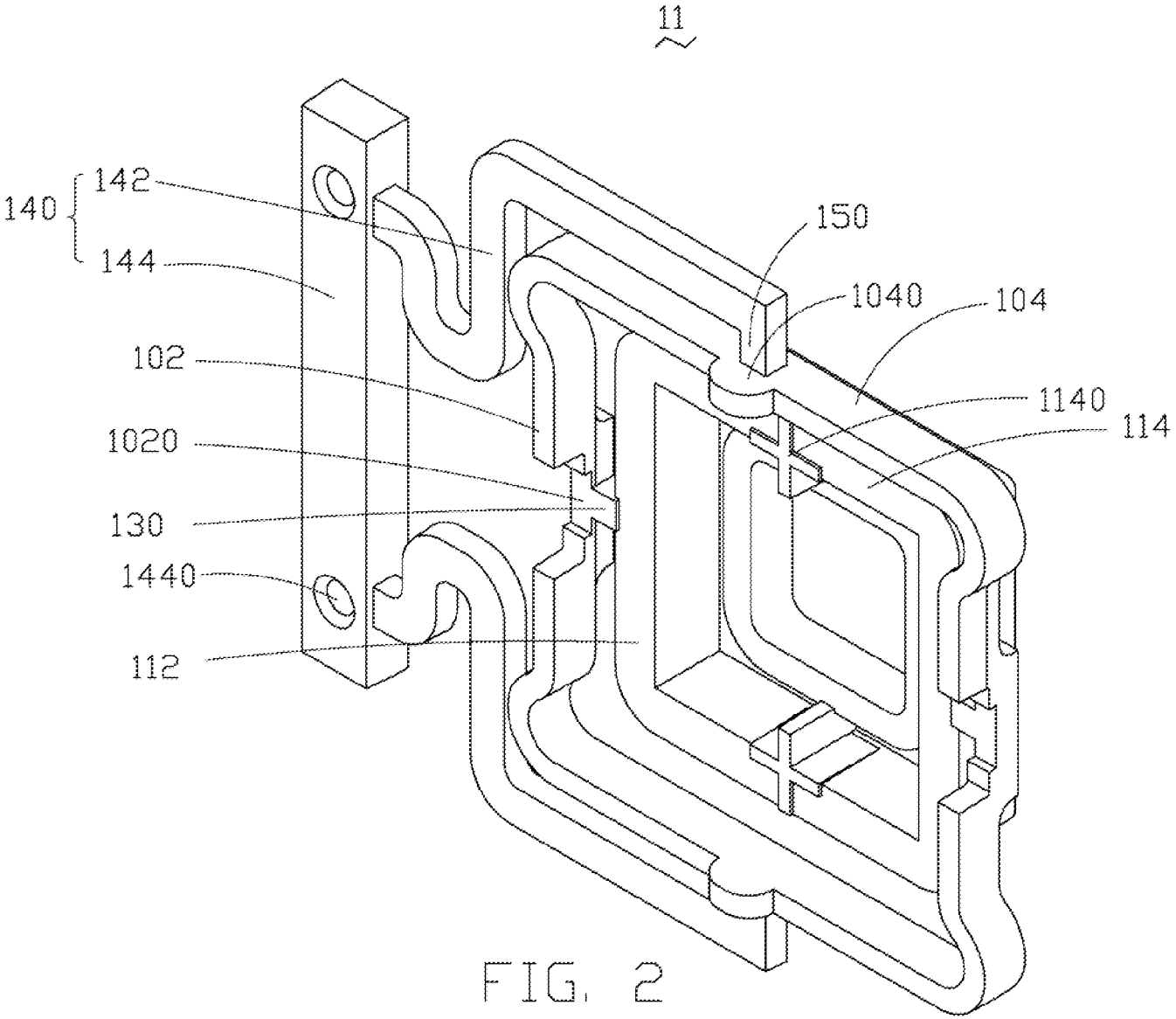
FIG. 2 is an inverted, isometric view of the multi-directional key of FIG. 1.

FIG. 1 is an isometric view of one embodiment of a multi-directional key 11 in accordance with the present disclosure. FIG. 2 is an inverted, isometric view of the multi-directional key 11 of FIG. 1.

The multi-directional key 11 includes a hollow frame 100, a key substrate 110, a multi-directional key body 120, and a first supporting frame 140.

The hollow frame 100 includes a pair of first opposite parallel bars 102 and a pair of second opposite parallel bars 104. Perpendicular planes of the first opposite parallel bars 102 and the second opposite parallel bars 104 are substantially perpendicular to each other. In one embodiment, the hollow frame 100 may be rectangular-shaped, while joints between the first opposite parallel bars 102 and the second opposite parallel bars 104 may be arc-shaped. In another embodiment, the hollow frame 100 may be circular-shaped.

Each of the first opposite parallel bars 102 of the hollow frame 100 includes a shoulder portion 1020 substantially placed in a center of each of the first opposite parallel bars 102. The shoulder portion 1020 makes the center of each first opposite parallel bar 102 to protrude outwardly. Correspondingly, each first opposite parallel bar 102 defines a groove placed inside each first opposite parallel bar 102. In another embodiment, a pair of stanchions 1022 may be positioned on the shoulder portion 1020 and accommodated in the groove.

Each second opposite parallel bar 104 of the hollow frame 100 includes a supporting portion 1040 protruding opposite to the multi-directional key 11 for supporting the hollow frame 100 so that the hollow frame 100 can pivotally rotate about the supporting portion 1040. In one embodiment, the supporting portion 1040 may be shaped like a half-circle.

The key substrate 110 includes a pair of third opposite parallel bars 112 which includes two sides of the key substrate 110 corresponding to the sides of the first opposite parallel bars 102 of the hollow frame 100. The pair of third opposite parallel bars 112 of the key substrate 110 is connected to the shoulder portions 1020 of the first opposite parallel bars 102 by a pair of first connection portions 130. In one embodiment, the key substrate 110 is rectangular-shaped and is accommodated in the hollow frame 100. One end of the first connection portion 130 is connected to the shoulder portion 1020 of the first opposite parallel bars 102 of the hollow frame 100, while another end of the first connection portion 130 is connected to a center of the third opposite parallel bars 112 of the key substrate 110. Therefore, the key substrate 110 can rotate slightly about the first connection portion 130.

The key substrate 110 further includes a pair of fourth opposite parallel bars 114 which are two sides of the key substrate 110 corresponding to the sides of the second opposite parallel bars 104 of the hollow frame 100. Perpendicular planes of the third opposite parallel bars 112 and the fourth opposite parallel bars 114 are substantially perpendicular to each other. In another embodiment, the key substrate 110 may also be circular-shaped.

Each of the fourth opposite parallel bars 114 of the key substrate 110 includes a first pressing portion 1140 substantially placed on a center of each of the fourth opposite parallel bars 114. In one embodiment, the first pressing portion 1140 is shaped as a tri-dimensional cross. In another embodiment, the first pressing portion 1140 may be shaped having a cylindrical shape.

The multi-directional key body 120 is positioned on the key substrate 110. The multi-directional key body 120 includes a pair of first keys 124 and a pair of second keys 126 on the surface of the multi-directional key body 120 for indicating a toggle direction of the multi-directional key body 120. In another embodiment, the multi-directional key body 120 may be integrated with the key substrate 110.

In one embodiment, the multi-directional key body 120 defines a hole 122 in a center of the multi-directional key body 120. The hole 122 may be rectangular-shaped. In other embodiments, the multi-directional key body 120 may not define the hole 122.

The first supporting frame 140 is connected to the second opposite parallel bars 104 of the hollow frame 100 by a pair of second connection portions 150. In one embodiment, the first supporting frame 140 includes a pair of first supporting arms 142. Each second connection portion 150 is connected to a center of each second opposite parallel bar 104 of the hollow frame 100. In one embodiment, the first supporting arms 142 may be designed having a sinuous shape for increasing the flexibility of the multi-directional key 11.

The first supporting frame 140 further includes a first fixing portion 144. In one embodiment, the first fixing portion 144 is elongated. Each end of the first fixing portion 144 is connected to each of the pair of first supporting arms 142. The first fixing portion 144 defines a pair of first assembling holes 1440 for assembling the multi-directional key 11 with an electronic device.

Figure 3:
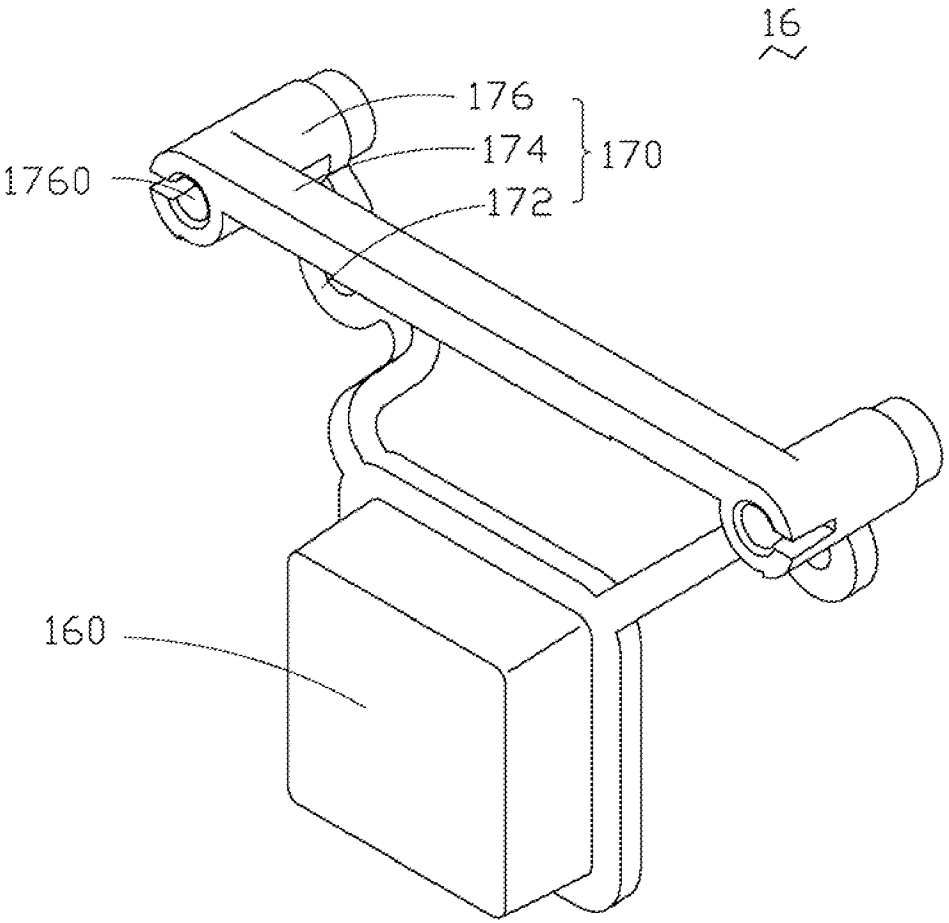
FIG. 3 is an isometric view of one embodiment of a single-directional key in accordance with the present disclosure.
Figure 4:
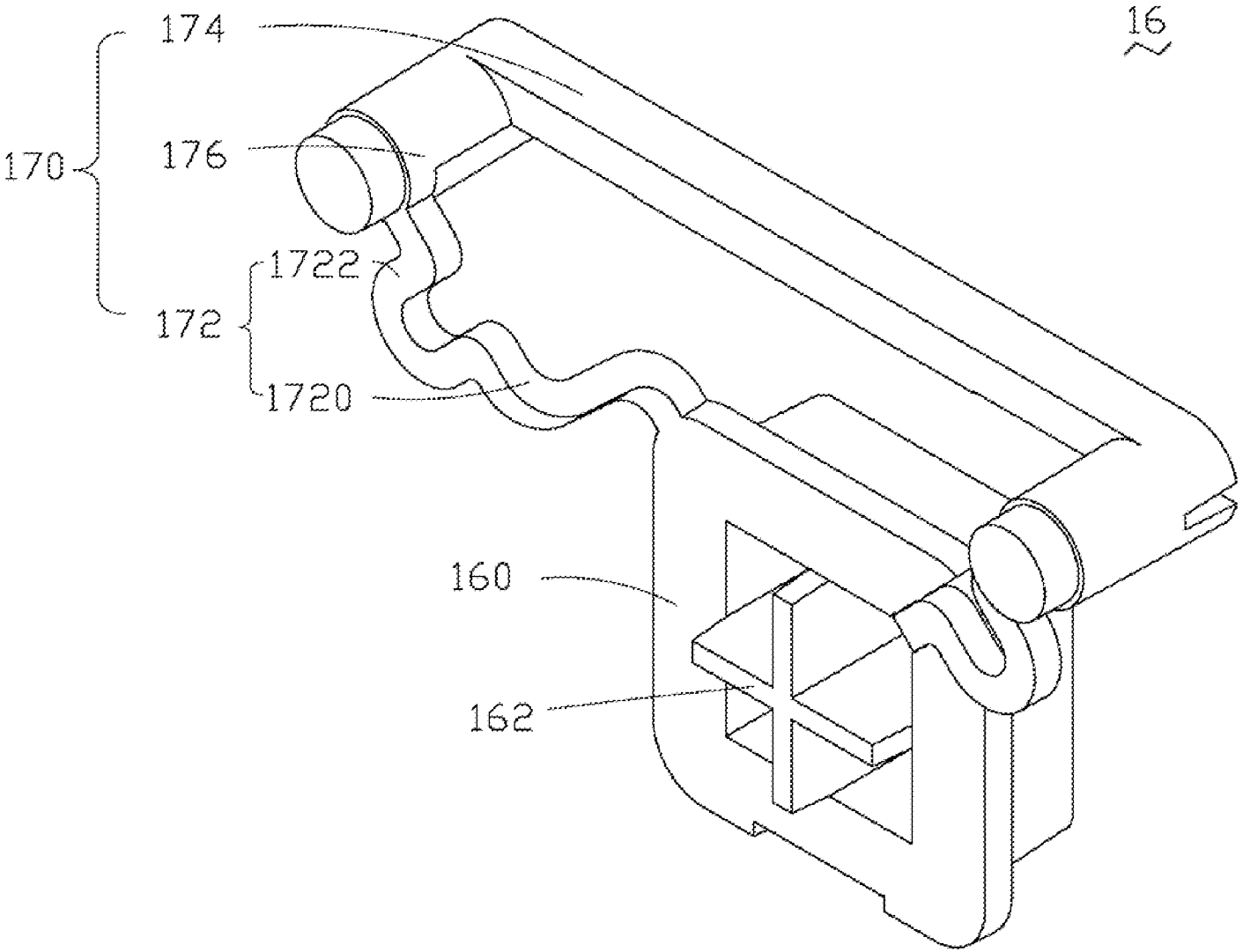
FIG. 4 is an inverted, isometric view of the single-directional key of FIG. 3.
Figure 5:
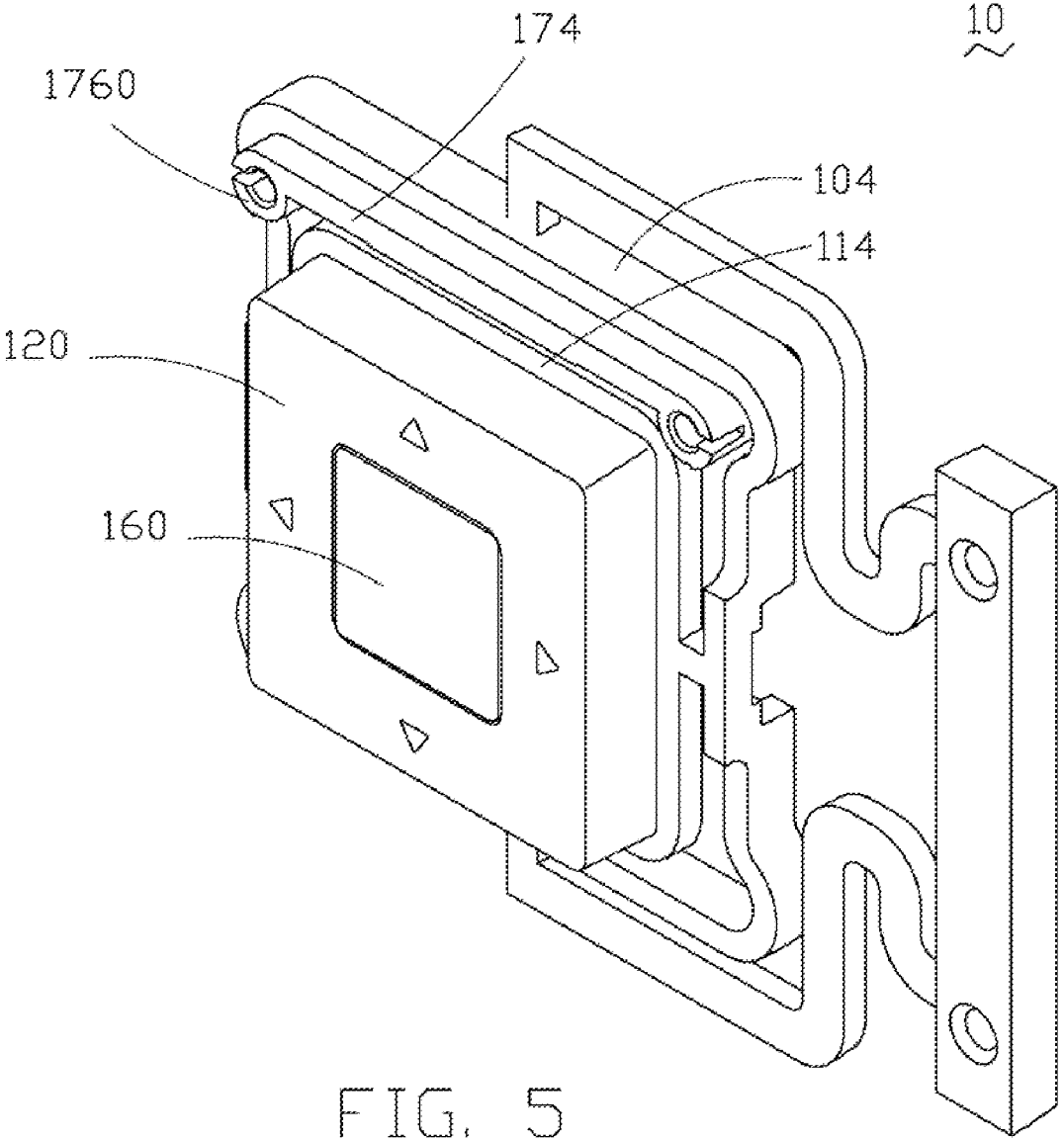
FIG. 5 is an isometric view of one embodiment of a key assembly in accordance with the present disclosure.

FIG. 3 is an isometric view of one embodiment of a single-directional key 16 in accordance with the present disclosure. FIG. 4 is an inverted, isometric view of the single-directional key 16 of FIG. 3. The single-directional key 16 includes a single-directional key body 160 and a second supporting frame 170. FIG. 5 is an isometric view of one embodiment of a key assembly 10 in accordance with the present disclosure. The key assembly 10 includes the multi-directional key 11 and the single-directional key 16.

The single-directional key body 160 is accommodated in the hole 122 defined by the multi-directional key body 120. In one embodiment, the single-directional key body 160 may be rectangular-shaped. In another embodiment, the single-directional key body 160 may be circular-shaped.

The single-directional key body 160 includes a second pressing portion 162. In one embodiment, the second pressing portion 162 may shaped as a tri-dimensional cross. In another embodiment, the second pressing portion 162 may be cylindrically shaped.

The second supporting frame 170 is connected to the single-directional key body 160 for supporting and fixing the single-directional key body 160.

The second supporting frame 170 includes a pair of second supporting arms 172 connected to the single-directional key body 160 for supporting the single-directional key body 160. In one embodiment, each second supporting arm 172 includes a former supporting arm 1720 and a latter supporting arm 1722 for increasing the flexibility of the single-directional key body 16. The former supporting arm 1720 and the latter supporting arm 1722 are both U shaped. The plane of the former supporting arm 1720 and that of the latter supporting arm 1722 are substantially perpendicular to each other.

The second supporting frame 170 further includes a second fixing portion 174. The second fixing portion 174 includes a pair of assembling stanchions 176 placed on two ends of the second fixing portion 174. Each assembling stanchion 176 defines a second assembling hole 1760 for assembling the second supporting frame 170 with the electronic device. The assembling stanchions 176 connect the second fixing portion 174 to the second supporting arms 172. In one embodiment, the assembling stanchions 176 may be cylindrically shaped. Each assembling stanchion 176 flanks with each end of the second fixing portion 174 and each of the second supporting arms 172.

In one embodiment, when assembling the multi-directional key 11 with the single-directional key 16, the second fixing portion 174 and the assembling stanchions 176 are accommodated in the space formed by the second opposite parallel bars 104 of the hollow frame 100 and the fourth opposite parallel bars 114 of the key substrate 110.

An electronic device employing the key assembly 10 includes the key assembly 10, a panel 20 and a circuit board 30.

Figure 6:
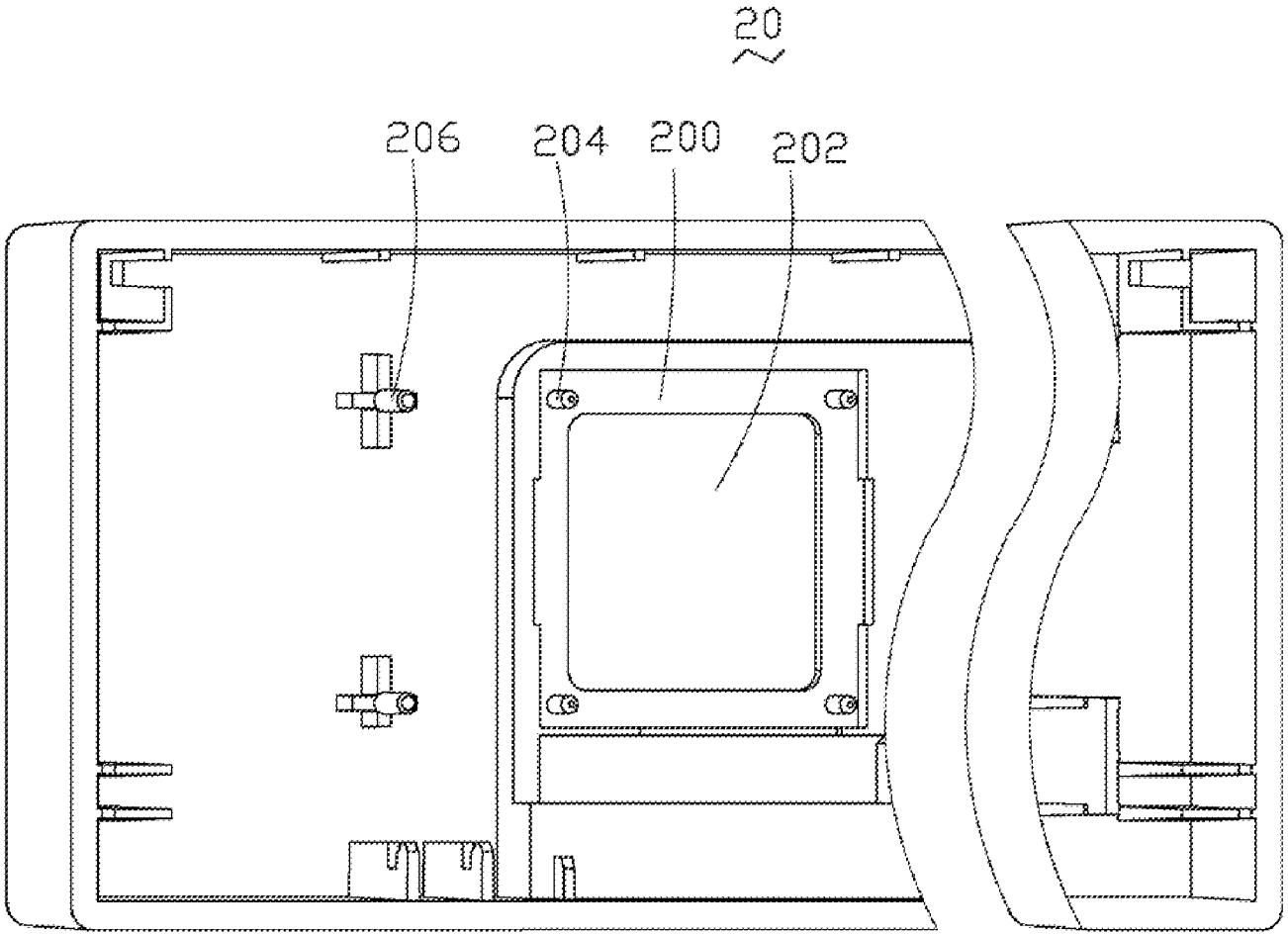
FIG. 6 is an isometric view of one embodiment of a panel in accordance with the present disclosure.
Figure 7:
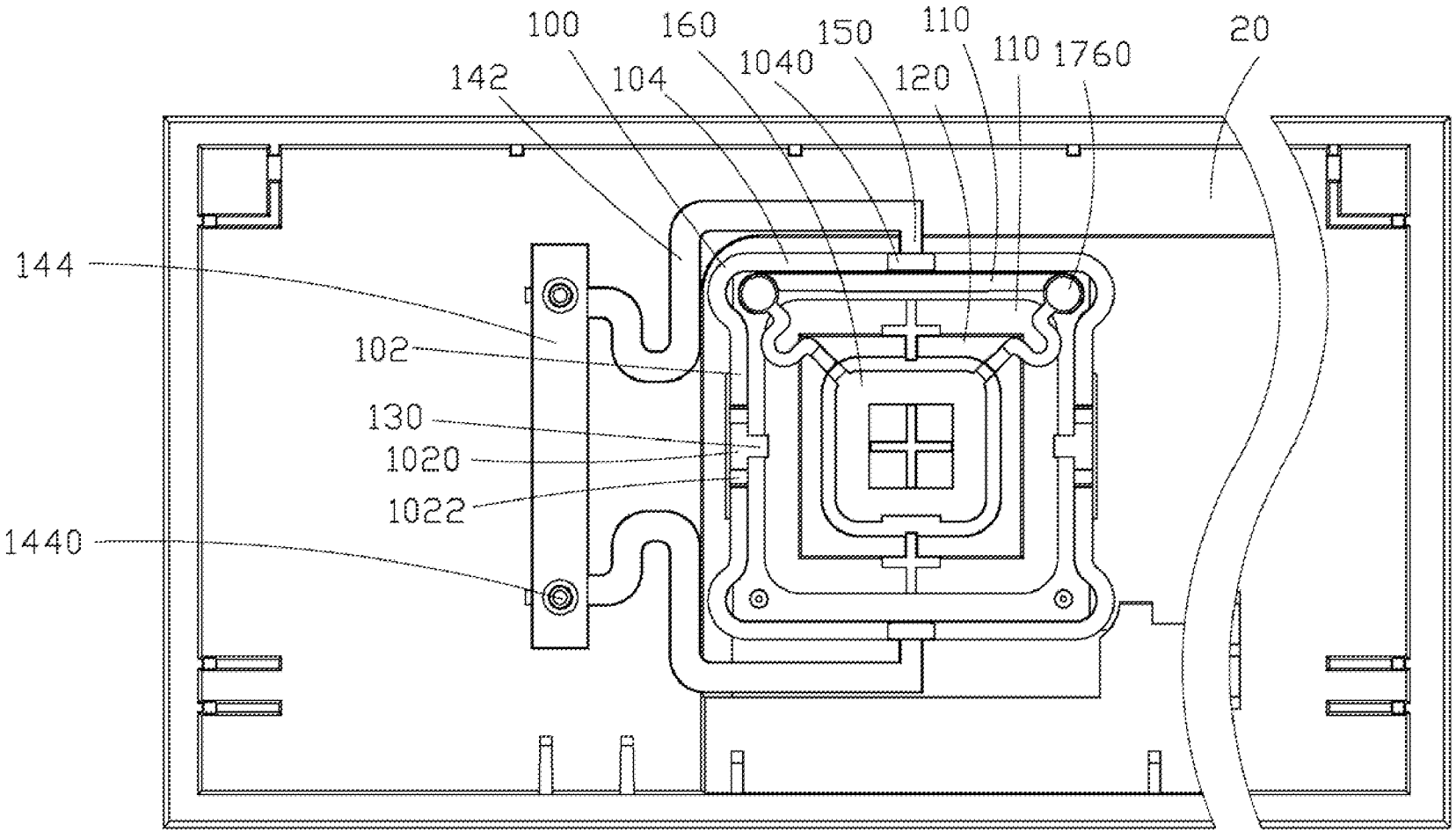
FIG. 7 is an inverted, isometric view of the panel of FIG. 6 and the key assembly of FIG. 5.
Figure 8:
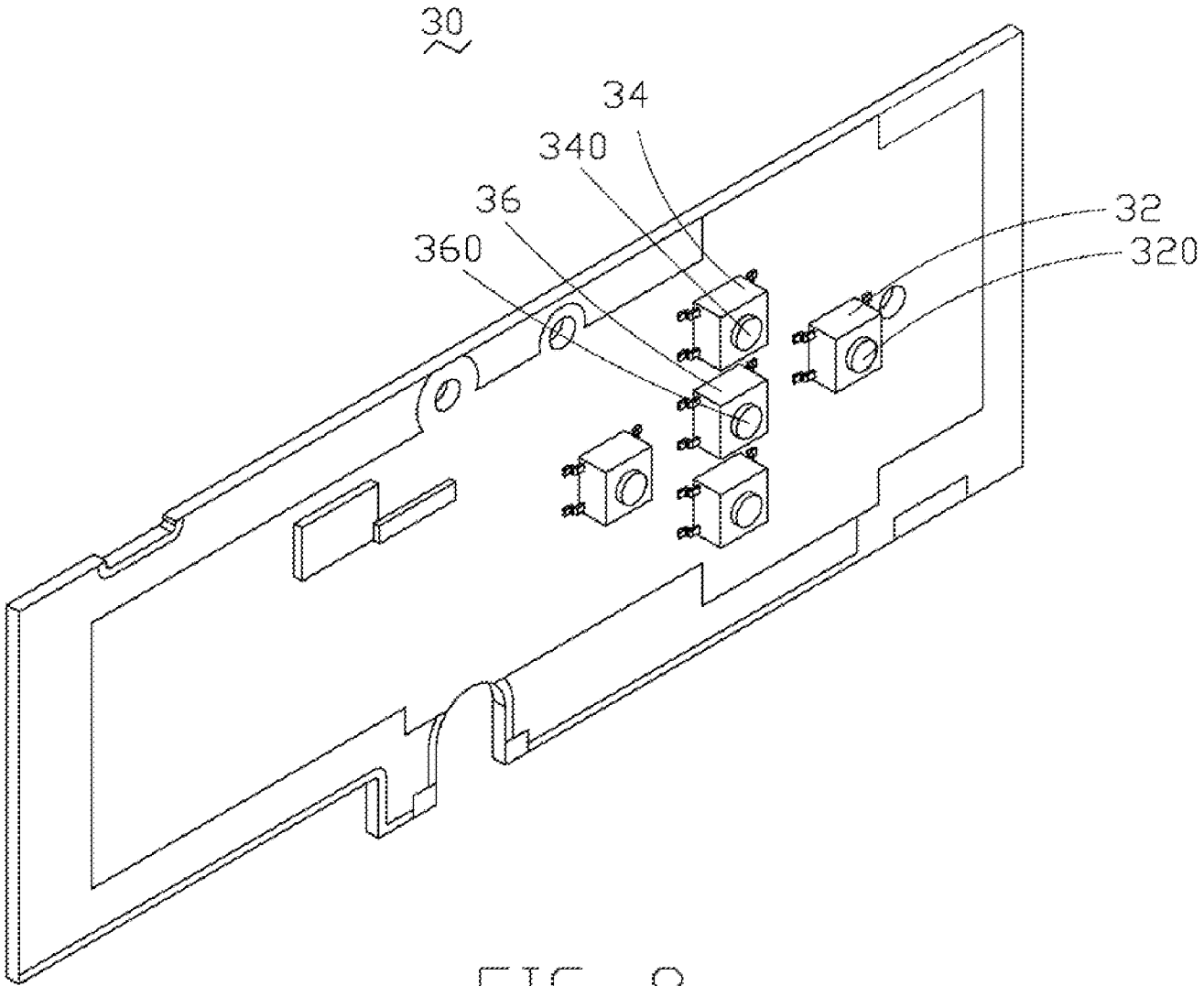
FIG. 8 is an isometric view of one embodiment of a circuit board in accordance with the present disclosure.
Figure 9:
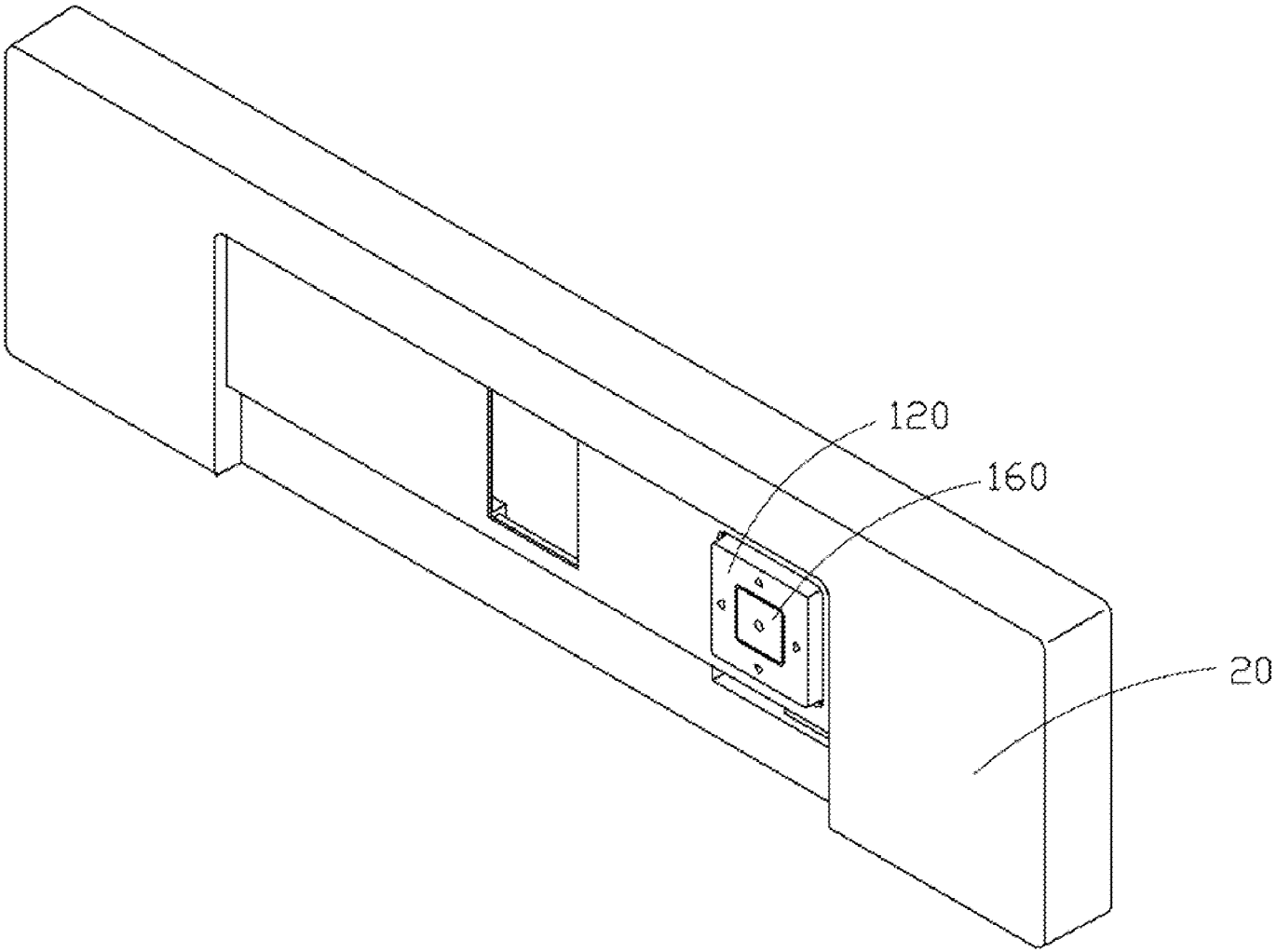
FIG. 9 is an isometric view of one embodiment of an electronic device in accordance with the present disclosure.

FIG. 6 is an isometric view of one embodiment of the panel 20 in accordance with the present disclosure. FIG. 7 is an inverted, isometric view of the panel 20 of FIG. 6 and the key assembly 10 of FIG. 5. FIG. 8 is an isometric view of one embodiment of the circuit board 30 in accordance with the present disclosure. FIG. 9 is an isometric view of one embodiment of the electronic device employing the key assembly 10 in accordance with the present disclosure.

The panel 20 includes a resisting portion 200 for resisting pressure from the key substrate 110. The resisting portion 200 defines an assembling hole 202 for accommodating the multi-directional key body 120 and the single-directional key body 160. The resisting portion 200 includes four protruding portions 204. Each of the four protruding portions 204 is positioned on each corner of the resisting portion 200. The resisting portion 200 is configured for locking the assembling stanchion 176 on the panel 20 via the pair of second assembling holes 1760. The panel 20 further includes a pair of fixing pillars 206 for locking the multi-directional key 11 on the panel 20 via the first assembling holes 1440.

By assembling the key assembly 10 and the panel 20, the multi-directional key body 120 protrudes out from the assembling hole 202 of the resisting portion 200 and the key substrate 110 resists the resisting portion 200 on the panel 20. As a result, the protruding portions 204 protrude out between the hollow frame 100 and the key substrate 110. The first fixing portion 144 of the multi-directional key 11 is locked on the fixing pillar 206 of the panel 20 through the first assembling holes 1440 on the first fixing portion 144. The single-directional key body 160 resists the key substrate 110 and protrudes out from the hole 122 of the multi-directional key body 120. The protruding portions 204 of the resisting portion 200 are assembled in the second assembling hole 1760 of the assembling stanchion 176. The second fixing portion 174 is then locked on the panel 20 via the assembling stanchion 176.

The circuit board 30 includes a pair of first switches 32, a pair of second switches 34, and a third switch 36. The first switches 32, second switches 34, and the third switch 36 respectively include touching portions 320, 340, and 360 thereon. By assembling the key assembly 10, the panel 20, and the circuit board 30, each of the first switches 32 is accommodated in the groove defined by each of the shoulder portions 1020, each of the second switches 34 is placed over each of the first pressing portions 1140 of the key substrate 110, and the third switch 36 is placed over the second pressing portion 162 of the single-directional key body 160. In another embodiment, each of the touching portions 320 of the first switches 32 is accommodated between the pair of stanchions 1022 configured on each shoulder portion 1020.

In a further embodiment, the multi-directional key 11 and the single-directional key 16 may also be placed on the circuit board 30.

Because each first connection 130 connects the multi-directional key body 120 to each shoulder portion 1020, the multi-directional key body 120 and the key substrate 110 slightly rotates around the second connection portion 150 when the first key 124 of the multi-directional key body 120 is affected by an external force. Therefore, the shoulder portion 1020 of the hollow frame 100 resists the first switch 32 and presses the touching portion 320 on the first switch 32. In another embodiment, the pair of stanchions 1022 configured on each shoulder portion 1020 withstands the first switch 32 when the touching portion 320 of the first switch 32 is slightly pressed, which can prevent the touching portion 320 from damage due to being excessively pressed, in addition to interference from the first and second keys 124 and 126.

When the second key 126 of the multi-directional key body 120 is affected by an external force, the multi-directional key body 120, the key substrate 110 and the hollow frame 100 rotates slightly about the first connection portion 130. Therefore, the first pressing portion 1140 of the key substrate 110 resists the second switch 34 and presses the touching portion 340 on the second switch 34.

When the single-directional key body 160 is affected by an external force, the second pressing portion 162 on the single-directional key body 160 resists the third switch 36 and presses the touching portion 360 on the third switch.

In one embodiment, the multi-directional key 11 and the key assembly 10 employing the multi-directional key 11 in the present disclosure have a plurality of keys placed compactly, such as four keys 124, 126 on the multi-directional key body 120, the single-directional key body 160. These keys 124, 126 are protected against interference between each other via the first connection portion 130 and the second connection portion 150.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A multi-directional key for an electronic device, comprising:

a hollow frame, comprising a pair of first opposite parallel bars, a pair of second opposite parallel bars, and a pair of supporting portions, wherein perpendicular planes of the first opposite parallel bars and perpendicular planes of the second opposite parallel bars are substantially perpendicular to each other, the pair of supporting portions are substantially placed in a center of the second opposite parallel bars of the hollow frame;

a key substrate, wherein each of two opposite sides of the key substrate is correspondingly connected to each of the first opposite parallel bars of the hollow frame by a pair of first connection portions;

a multi-directional key body positioned on the key substrate; and a supporting frame connected to the second opposite parallel bars of the hollow frame by a pair of second connection portions.

2. The multi-directional key as claimed in claim 1, wherein the supporting frame comprises a pair of supporting arms, and each of the supporting arms is correspondingly connected to each of the pair of second connection portions.

3. The multi-directional key as claimed in claim 1, wherein the hollow frame further comprises a pair of shoulder portions substantially placed in centers of the first opposite parallel bars of the hollow frame.

4. The multi-directional key as claimed in claim 3, wherein each of the two opposite sides of the key substrate is correspondingly connected to each of the pair of shoulder portions of the hollow frame via each of the pair of first connection portions.

5. The multi-directional key as claimed in claim 4, wherein each shoulder portion comprises a pair of stanchions.

6. The multi-directional key as claimed in claim 1, wherein the supporting frame is substantially connected to the centers of the second opposite parallel bars of the hollow frame by the pair of second connection portions.

7. The multi-directional key as claimed in claim 1, wherein the key substrate is integrated with the multi-directional key body.

8. The multi-directional key as claimed in claim 1, wherein the multi-directional key body defines a hole in a center of the multi-directional key body.

9. A key assembly, comprising:

a multi-directional key, comprising:

a hollow frame comprising a pair of first opposite parallel bars, a pair of second opposite parallel bars, and a pair of supporting portions, wherein perpendicular planes of the first opposite parallel bars and perpendicular planes of the second opposite parallel bars are substantially perpendicular to each other, the pair of supporting portions are substantially placed in a center of the second opposite parallel bars of the hollow frame;

a key substrate, wherein each of two opposite sides of the key substrate is correspondingly connected to each of the first opposite parallel bars of the hollow frame by a pair of first connection portions;

a multi-directional key body positioned on the key substrate and defining a hole in a center of the multi-directional key body; and a first supporting frame connected to the second opposite parallel bars of the hollow frame by a pair of second connection portions; and a single-directional key, comprising:

a single-directional key body adapted to fit in the hole defined by the multi-directional key body; and a second supporting frame connected with the single-directional key body for supporting and fixing the single-directional key body.

10. The key assembly as claimed in claim 9, wherein the first supporting frame comprises a pair of first supporting arms and each of the supporting arms is correspondingly connected to each of the pair of second connection portions.

11. The key assembly as claimed in claim 9, wherein the hollow frame further comprises a pair of shoulder portions substantially placed in centers of the first opposite parallel bars of the hollow frame.

12. The key assembly as claimed in claim 11, wherein each of the two opposite sides of the key substrate is correspondingly connected to each of the pair of shoulder portions of the hollow frame via each of the pair of first connection portions.

13. The key assembly as claimed in claim 12, wherein each shoulder portion comprises a pair of stanchions.

14. The key assembly as claimed in claim 9, wherein the first supporting frame is substantially connected to the centers of the second opposite parallel bars of the hollow frame by the pair of second connection portions.

15. The key assembly as claimed in claim 9, wherein the key substrate is integrated with the multi-directional body.

16. The key assembly as claimed in claim 9, wherein the second supporting frame comprises a pair of second supporting arms connected with the single-directional body.

17. The key assembly as claimed in claim 16, wherein the second supporting frame further comprises a fixing portion connected to the pair of second supporting arms.

* * * * *